US009261286B1

(12) United States Patent
Seeley

(10) Patent No.: US 9,261,286 B1
(45) Date of Patent: Feb. 16, 2016

(54) ADJUSTABLE VENT ADAPTER FOR CLOTHES DRYER

(71) Applicant: Gene Seeley, Ocean Shores, WA (US)

(72) Inventor: Gene Seeley, Ocean Shores, WA (US)

( * ) Notice: Subject to any disclaimer, the term of this patent is extended or adjusted under 35 U.S.C. 154(b) by 662 days.

(21) Appl. No.: 13/705,113

(22) Filed: Dec. 4, 2012

Related U.S. Application Data

(60) Provisional application No. 61/567,303, filed on Dec. 6, 2011.

(51) Int. Cl.
*F16L 27/00* (2006.01)
*F24F 7/04* (2006.01)

(52) U.S. Cl.
CPC ..... *F24F 7/04* (2013.01)

(58) Field of Classification Search
USPC ..... 285/126.1, 127.1, 129.1, 144.1, 148.1, 285/184, 272, 272.1, 424, 148.4, 133.6
See application file for complete search history.

(56) References Cited

U.S. PATENT DOCUMENTS 262,049 A * 8/1882 Kearns ..... F16L 27/0849 285/184
706,888 A * 8/1902 Blyth ..... F16L 13/126 285/148.1
897,700 A 9/1908 Ashbaugh
1,304,980 A 5/1919 Hirshstein
1,409,022 A 3/1922 Paxton
1,729,483 A * 9/1929 Koch ..... F16L 15/006 131/225
2,447,947 A 8/1948 Larson et al.
2,581,047 A 1/1952 Salmond et al.
2,730,383 A * 1/1956 Ballard ..... F16L 37/252 277/607
2,825,586 A 3/1958 Robboy
D215,003 S 8/1969 Stevens et al.
3,704,034 A 11/1972 Shire et al.
3,960,142 A 6/1976 Elliott et al.
4,071,268 A 1/1978 Halling et al.
D273,702 S 5/1984 Widerby et al.
4,589,160 A * 5/1986 Day ..... B60S 3/002 15/316.1
4,890,396 A 1/1990 King
4,989,347 A 2/1991 Kretchman
5,066,050 A 11/1991 Kretchman
5,121,948 A 6/1992 Anderson et al.
5,145,217 A 9/1992 Anderson et al.
5,158,328 A 10/1992 Anderson et al.
5,584,129 A 12/1996 Williamson
5,645,482 A 7/1997 Moss et al.
5,819,435 A 10/1998 Tuggle
5,887,908 A 3/1999 White
6,578,286 B2 6/2003 Seeley
6,581,974 B1 * 6/2003 Ragner ..... F16L 27/0849 285/12
6,991,262 B1 * 1/2006 Ragner ..... A47L 9/06 15/417
2002/0108265 A1 * 8/2002 Seeley ..... D06F 58/20 34/138
2006/0012166 A1 * 1/2006 Siferd ..... F16L 27/08 285/184

(Continued)

*Primary Examiner* — Aaron Dunwoody
(74) *Attorney, Agent, or Firm* — R. Reams Goodloe, Jr.

(57) ABSTRACT

An adjustable dryer vent transition device. The device provides an adjustable dryer vent adapter with an elongated first duct and an elongated second duct which are rotatably adjustable with respect each to the other. An external inlet is provided at the elongated first duct for receiving hot most air from a clothes dryer. An external exit is provided from the elongated second duct for discharge of hot moist air from a clothes dryer. The adjustable dryer vent adapter provides a three hundred sixty (360) degree freedom of movement for placement of the external inlet and the external outlet along centerlines that may be coincident, or spaced maximally apart according to the distances afforded by the length of elongated first duct and elongated second duct, and at any rotational angle with respect to an outlet stub from a clothes dryer.

10 Claims, 8 Drawing Sheets

(56) References Cited

U.S. PATENT DOCUMENTS

2006/0071472 A1* 4/2006 Pasotti ..... E03C 1/284
285/272

2012/0073158 A1* 3/2012 Sciallo ..... D06F 58/20
34/235

* cited by examiner

ADJUSTABLE VENT ADAPTER FOR CLOTHES DRYER

RELATED PATENT APPLICATIONS

This application claims priority from U.S. Provisional Patent Application Ser. No. 61/567,303, filed on Dec. 6, 2011, entitled ADJUSTABLE VENT ADAPTER FOR CLOTHES DRYER, the disclosure of which is incorporated herein in its entirety, including the specification, drawing, and claims, by this reference.

TECHNICAL FIELD

The present disclosure relates to clothes dryer vents, and more specifically, to a dryer vent adapter useful for installation of a clothes dryer, in order to compensate for misalignment between a clothes dryer exhaust outlet, and a discharge vent line for receiving hot moist air from a clothes dryer for transport through a wall or the like to an exterior exhaust discharge point.

BACKGROUND

Clothes dryers are used to remove moisture from clothing and/or other textiles, generally after such materials have been cleaned in a washing machine. Most clothes dryers which are designed for use in homes, apartments, or otherwise, have a hot air exhaust outlet for the discharge of hot air containing the moisture just removed from the clothing and/or other textiles being dried. In anticipation of installation of a clothes dryer, builders will generally install a receptacle to a discharge vent line as indicated in the plans, or as judged on site to be most practical. The receptacle and downstream discharge vent line are configured to receive the hot, moisture laden air for routing to and discharge at a suitable location discharge point, normally outdoors. However, clothes dryers come in various sizes, with varying heights and lateral locations of a hot air exhaust outlet. Thus, in most instances, during installation of a clothes dryer, the hot air exhaust outlet of the clothes dryer is not in alignment with the receptacle of the discharge vent line. Thus, there is a requirement for a dryer vent transition device or assembly for securely and safely routing hot moist exhaust air from the clothes dryer to a receptacle for a line configured for transport and exterior exhaust discharge of such hot moist air.

Various attempts have been made, with varying degrees of success, to provide an apparatus for use in various methods of compensating for misalignment between hot air exhaust outlets on clothes dryers and the receptacles for the discharge vent lines, so as to provide a suitable dryer vent transition device. One of the more useful configurations amongst various prior art vent adapters is described in my prior U.S. Pat. No. 6,578,286 B2, which issued Jun. 17, 2003, entitled Clothes Dryer Vent Adapter. In that apparatus, first and second cylindrical portions are provided which are adjustably positionable to a desired configuration for alignment of an inlet on the first cylindrical portion with a dryer hot air exhaust outlet, and for alignment of an outlet on the second cylindrical portion with the receptacle of a discharge vent line. However, offset distance available by use of that device is effectively limited by the diameter of the first and second cylindrical portions. As a practical matter, the offset-reach that may be overcome with that prior art design is limited, and in many embodiments of that design, such off-set reach distance may not exceed about eight (8) inches, or slightly less, when rather expensive adjoining cylindrical tubular segments of about twelve (12) inches in diameter are utilized. If smaller, less expensive adjoining cylindrical tubular segments of about eight (8) inches or less in diameter are utilized in that prior art design, then the misalignment, or offset-reach distance that may be overcome is limited to the maximum range of up to about three and a half (3.5) inches or thereabouts.

Thus, in spite of the extensive body of prior art for vent adapters for installation of clothes dryers, there still remains an as yet unmet need for an improved vent adapter that simply and effectively allows for use both when only a slight amount of misalignment needs to be corrected, as well as when relatively large misalignment distances need to be overcome. Availability of such an improved dryer vent adapter would reduce installation time, and be easy to utilize, especially if provided in a configuration that would accommodate an extension length that is as great as, or greater than, the typically encountered proposed center to center distance between a hot air exhaust outlet on a clothes dryer and a receptacle of a discharge vent line in a structure in which the dryer is to be installed. Moreover, it would be advantageous if such an apparatus were available in (or could easily be manufactured using) inexpensive materials, in an easy to use design, and manufacturable in various standard configurations and sizes.

OBJECTS, ADVANTAGES, AND NOVEL FEATURES

My novel adjustable dryer vent as disclosed herein includes a first duct having an inlet, a second duct having an outlet, and a joint therebetween rotating the second duct with respect to the first duct to a desired installation position, while preserving an effectively leak tight joint between the first duct and the second duct.

The adjustable dryer vent described herein is particularly advantageous in that it allows an installation contractor (or a homeowner's supply store) to maintain stock of a single part, rather than an assortment of parts, in order that the installer be prepared, during installation of a clothes dryer, to securely connect a clothes dryer exhaust outlet with a receptacle in a building structure for a discharge vent line, regardless of the offset distance that may be encountered, at least to a very large range of offset distances, and at any offset angle.

Further, it is an advantage that the adjustable dryer vent described herein may also be used when there is no offset distance, or offset angle, i.e., when the clothes dryer exhaust outlet and the receptacle in a building structure for a discharge vent line are perfectly in alignment.

It is also an object, in an embodiment of the adjustable dryer vent described herein that, to minimize or prevent leakage of warm moist air between first and second ducts, and such objective may be accomplished by design of the joint between the first and second ducts, and/or by providing a joint seal.

It is an object of the invention to provide an easily cleanable dryer vent adapter, and such objective may be accomplished, in an embodiment, by the use of a hinged end panel in the first duct and/or the second duct.

It is an advantage that in various embodiments, the first duct and the second duct may each be provided in the shape of hollow parallelepiped structures, and are adjustably arranged in a partially overlapping relationship, so that a joint between the first duct and the second duct may be securely provided in configuration with little or no leakage, so that warm moist and lint laden air does not escape into the area behind a clothes dryer.

In an embodiment, it is an advantage that the first duct and the second duct are easily adjusted with respect to each other, by the provision of a lubricated seal at the joint between the first duct and the second duct.

It is yet another objective to provide a dryer vent adapter that allows a clothes dryer to fit relatively tightly against a wall, without having to be concerned with restricted airflow as might result from crushed and/or contorted prior art flexible vent ducts.

In an embodiment, it is an advantage that the various components of the adjustable vent adapter may be provided using conventional sheet metal, and conventional sheet metal construction techniques, thereby minimizing cost.

Another objective is to provide a fire-safe dryer vent adapter.

Thus, it is yet a further advantage that the use of rigid materials of construction, such as the above mentioned conventional sheet metal, minimizes or avoids the buildup of lint, thus minimizing the danger of fire, as compared to prior art flexible plastic or metal structures that inherently include ridges, valleys, or crevices for accumulation of lint.

It is yet another objective to provide an adjustable vent adapter that reduces the installation labor time.

These and other objects, advantages, and novel features of the adjustable dryer vent adapter described herein will become apparent to the reader from the foregoing and from the appended claims, and the ensuing detailed description, as the discussion below proceeds in connection with examination of the accompanying figures of the drawing.

SUMMARY

I have now developed an improved dryer vent adapter. The device can be easily and quickly manually adjusted to overcome misalignment distance between a clothes dryer exhaust outlet and the receptacle for a discharge vent line that is configured for receiving hot moist air discharged from a clothes dryer. Further, in an embodiment, the device provides for accommodation of a small misalignment distance, and alternately for accommodation of a large misalignment distance. In an embodiment, misalignment distances in excess of about eight (8) inches may be accommodated during dryer installation. In an embodiment, misalignment offset distances of up to as much as about twenty (20) inches may be accommodated during dryer installation. In an embodiment, such an improved dryer vent adapter may be used even when there is no misalignment distance, thus saving labor and the costs of stocking of other devices to accommodate other offset-reach distance configurations.

In an embodiment, the dryer vent adapter includes a first duct having an inlet, and a second duct having an outlet, where the first duct and second duct are coupled and adjustably mounted with respect to each other. In an embodiment, the first duct and the second duct are rotatably mounted each with respect to the other, with a passageway therebetween adapted for passage of hot moist air through the passageway therebetween. In an embodiment, the first duct and the second duct are rotatably assembled in back-to-back fashion. In an embodiment, the passageway between the first duct and the second duct is coincident with an adjustable joint therebetween. In an embodiment, the first duct may be provided in the general configuration of a hollow parallelpiped sheet metal structure. In an embodiment, the second duct may be provided in the general configuration of a hollow parallelpiped sheet metal structure. In an embodiment, the first duct may have a generally rectangular cross-sectional configuration. In an embodiment, the second duct may have a generally rectangular cross-sectional configuration.

In an embodiment, the inlet to the first duct may be provided in a female configuration, adapted to receive a clothes dryer exhaust outlet. Tight fitting sizing may be utilized to minimize or eliminate leakage in the joint between the clothes dryer exhaust outlet and the inlet to the first duct. However, conventional duct tape suitable for the service conditions may be utilized to assure leak tight sealing of such first joint, in order to avoid outflow of moisture or lint from the clothes being dried. In an embodiment, the outlet from the second duct may be provided in a male configuration, adapted to connect with a building structure's receptacle for the dryer discharge vent line. Again, tight fitting sizing may minimize or eliminate leakage in such second joint between the outlet from the second duct and the receptacle for the discharge vent line. However, conventional duct tape suitable for the service conditions may also be utilized to assure sealing of such second joint. In any event, in various embodiments, and after fitting and alignment adjustment, an adjustable dryer vent as described herein may be quickly and easily manually secured for use.

The foregoing briefly describes certain aspects and elements of an exemplary adjustable vent adapter for clothes dryer installation, and various components thereof. The various objectives, features and advantages of the invention(s) will be more readily understood upon consideration of the detailed description, taken in conjunction with careful examination of the accompanying figures of the drawing.

BRIEF DESCRIPTION OF DRAWING

In order to enable the reader to attain a more complete appreciation of the invention, and of the novel features and advantages thereof, attention is directed to the following detailed description when considered in connection with the accompanying drawings, wherein.

Figure 1:
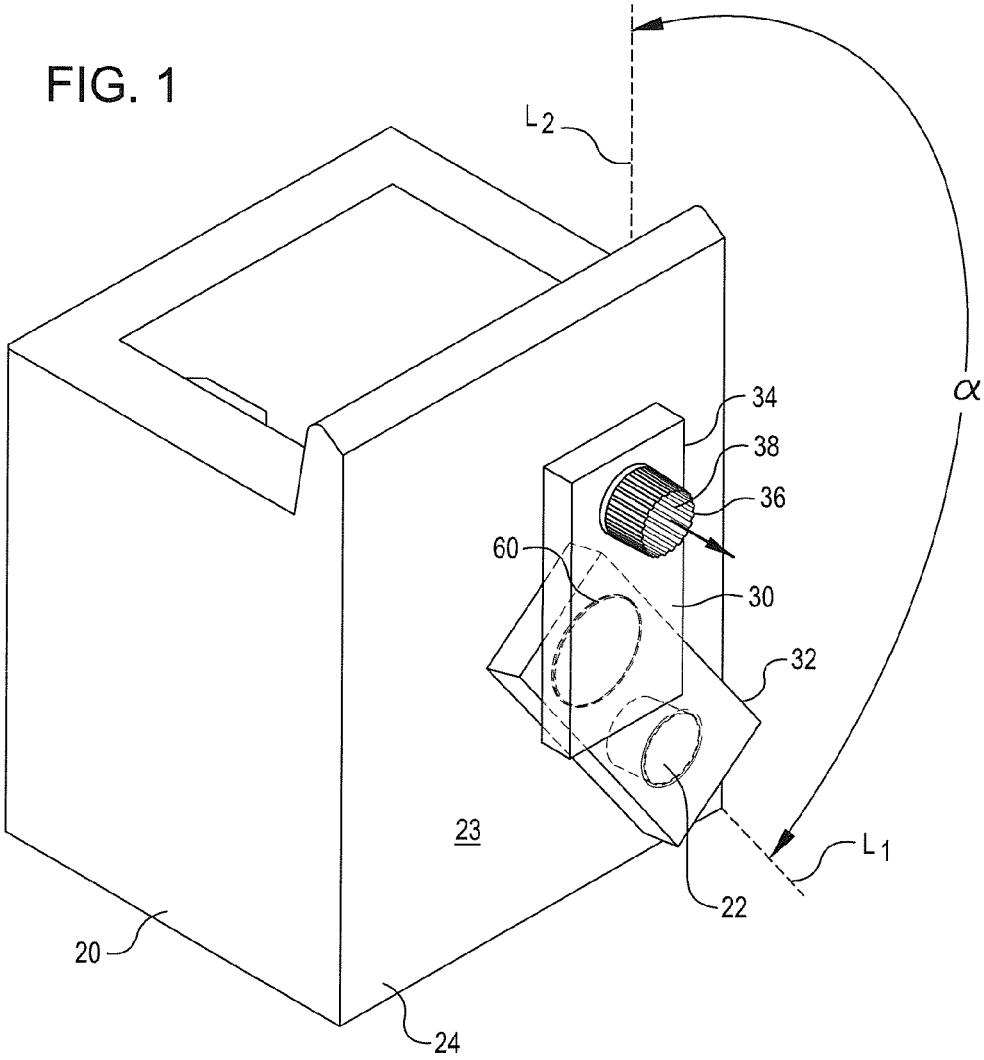
FIG. 1 provides a rear perspective view of a typical clothes dryer, showing an adjustable vent adapter as described herein affixed to the clothes dryer exhaust outlet, and configured for operational placement and connection to a receptacle (not shown) for a discharge vent line to a through-wall passageway in a selected building structure.

In the various figures of the drawing, like features may be illustrated with the same reference numerals, without further mention thereof. Further, the drawing figures are merely exemplary, and may contain various elements that might be present or omitted from actual implementations of various embodiments depending upon the circumstances. An attempt has been made to draw the figures in a way that illustrates at least those elements that are significant for an understanding of the various embodiments and aspects of the invention. However, the figures of the drawing are generalized in form in the interest of clarity and conciseness. Notably, other elements or functional components for an adjustable vent adapter for clothes dryer, as well as different embodiments or shapes of particular components such as the shape of certain elements such as the first ducts and second ducts as set forth herein, or an inlet to the first duct, or the outlet from the second duct, may be utilized in order to provide a useful, adjustable, and reliable vent adapter for clothes dryers, while within the literal scope and coverage of the claims set forth herein, or legal equivalents thereof.

DETAILED DESCRIPTION

Attention is directed to FIG. 1, which illustrates a typical clothes dryer 20 having an outlet vent stub 22 in the lower reaches 23 of the reverse side 24. An adjustable dryer vent adapter 30 is provided attached to the outlet vent stub 22. The adjustable dryer vent adapter 30 includes an elongated first duct 32 and an elongated second duct 34, which are arranged in an offset manner with respect to each other at a selected angle alpha ($\alpha$), which in this embodiment is an obtuse angle, that is, more than ninety (90) degrees but less than one hundred eighty (180) degrees. As further explained below, in various embodiments, angle alpha ($\alpha$) may be freely adjustable for dryer installation, that is, from no angular adjustment (where elongated first duct and elongated second duct are in overlapping alignment), to any adjustment, that is, having freedom of movement to any selected angle alpha ($\alpha$) among a full three hundred and sixty (360) degrees. Thus, adjustment can be made in any direction around the dryer outlet vent stub 22. The elongated second duct 34 is provided with an external outlet 36, which, in an embodiment as illustrated in FIG. 1, may be provided a generally cylindrical tubular configuration, with flutes 38, to make installation and fitting easier, and in a male configuration for insertion into a receptacle (not shown) for a dryer discharge vent line in a selected building structure.

Figure 2:
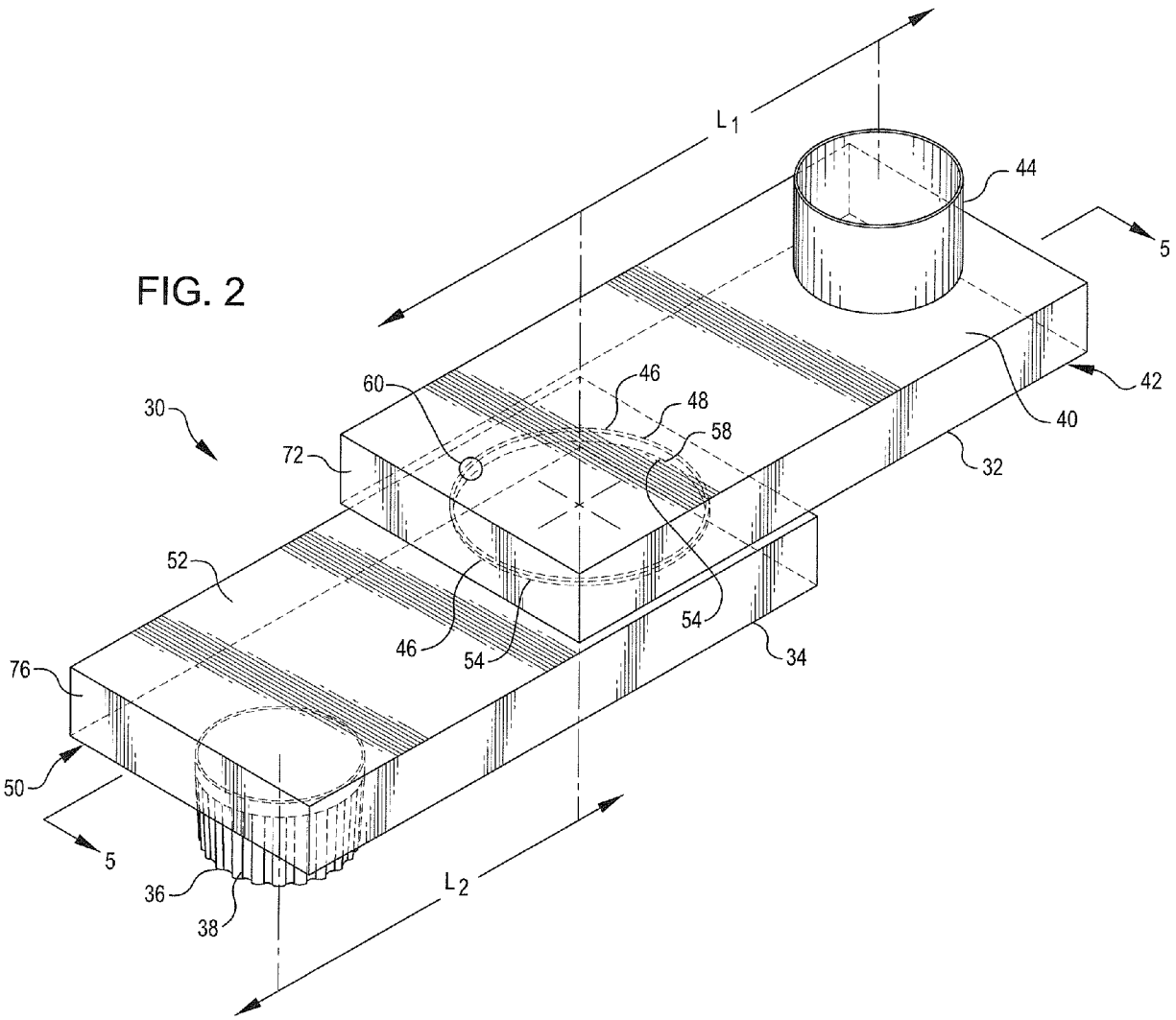
FIG. 2 provides a top perspective view of an embodiment of an adjustable vent adapter for clothes dryer, configured for passage of hot moist air from an external inlet to an elongated first duct to an external outlet from an elongated second duct, and configured in a fully extended arrangement for correction of misalignment between a clothes dryer exhaust outlet (not shown) for hot moist air, and a receptacle for a discharge vent line in a building structure (not shown).

Turning now to FIG. 2, a perspective view of an embodiment for an adjustable dryer vent adapter 30 is shown. The adjustable dryer vent adapter includes an elongated first duct 32 having an inlet side 40 and a first joint side 42. Located on the inlet side 40 is an external inlet 44. The first joint side 42 includes an internal exit 46, herein defined by broken lines indicating the position of outlet sidewall 48. The external inlet 44 and the internal exit 46 are spaced apart along a first longitudinal axis $L_1$ in a non-overlapping configuration. The elongated second duct 34 includes an outlet side 50 and a second joint side 52. The outlet side 50 further includes an external outlet 36. The second joint side 52 further includes an internal inlet 54, defined by inlet sidewalls shown by broken lines 58. The internal inlet 54 and the external outlet 36 are spaced apart along a second longitudinal axis $L_2$ in a non-overlapping configuration.

Figure 2A:
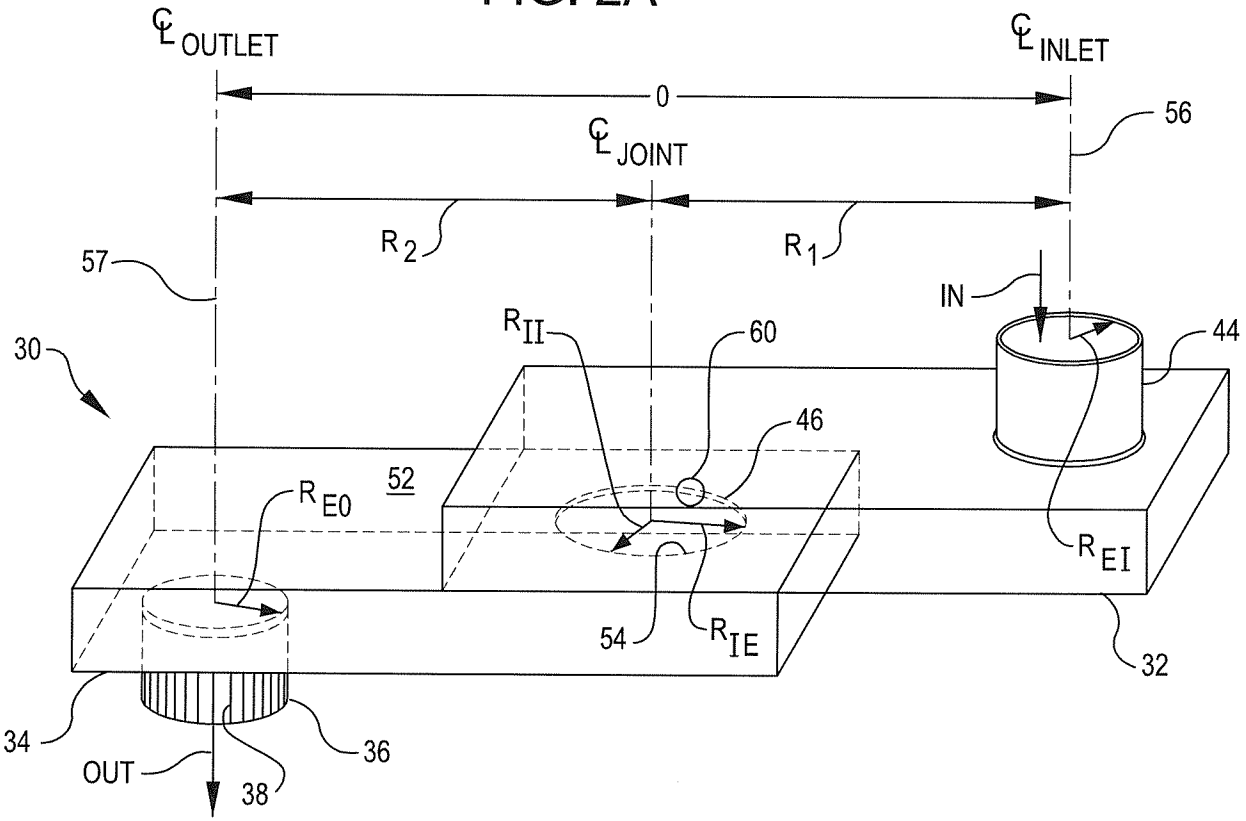
FIG. 2A provides another top perspective view of an embodiment of an adjustable vent adapter for clothes dryer, configured for passage of hot moist air from an external inlet to an elongated first duct to an external outlet from an elongated second duct, and configured in a fully extended arrangement for correction of misalignment between a clothes dryer exhaust outlet (not shown) for hot moist air, and a receptacle for a discharge vent line in a building structure (not shown), and further depicting the first turning radius $R_1$ afforded by the first duct, and the second radius $R_2$ afforded by the second duct, from as measured from centerlines of the inlet and the outlet.

As may be better seen in FIG. 2A, an adjustable dryer vent adapter 30 may be provided in an embodiment where the external inlet 44 is provided in a cylindrical tubular configuration of radius $R_E$ measured from an external inlet centerline. In an embodiment, the external inlet 44 may be provided in female configuration, for accepting the outlet vent stub 22 of the clothes dryer 20. Also, in an embodiment, the internal exit 46 may be provided with an outlet sidewall 48 in a generally circular configuration having a radius $R_{IE}$ measured from an internal exit joint centerline. In such instance, the elongated first duct 32 may be said to have a nominal length $R_1$ as measured from the external inlet centerline (indicated by reference numeral 56) to the internal exit joint centerline. In such an embodiment, $R_1$ may be provided sufficiently large and the radius $R_E$ and radius $R_{IE}$ may be each configured and spaced apart so that the external inlet 44 and the internal exit 46 do not overlap. In an embodiment, the nominal length $R_1$ may be provided at about seven and one half (7.5) inches, or less. Alternately, nominal length $R_1$ may be provided in a length exceeding about seven and one half (7.5) inches. Over time, for various locales, different standard lengths may be found to be useful, depending upon local construction practices, and the prevalent local dryer sizing and outlet vent stub 22 configurations.

As also seen in FIG. 2A, in an embodiment, the external outlet 36 may be provided in a cylindrical tubular configuration of radius $R_{EO}$ measured from an external outlet centerline. Further, in an embodiment, the internal inlet 54 may be provided in a generally circular configuration having a radius $R_{II}$ measured from an internal inlet or joint centerline. In an embodiment, the elongated second duct 34 has a nominal length $R_2$ as measured from the internal inlet 54 joint centerline to the external outlet 36 centerline (indicated by reference numeral 57). In such an embodiment, $R_2$ may be provided sufficiently large and the radius $R_{EO}$ and radius $R_{11}$ may be each configured and spaced apart so that the external outlet 34 and the internal inlet 54 do not overlap. In an embodiment, the nominal length $R_2$ may be provided at about seven and one half (7.5) inches, or less. Alternately, nominal length $R_2$ may be provided in a length exceeding about seven and one half (7.5) inches.

In various embodiments, an adjustable dryer vent adapter 30 may be provided using sheet metal for construction of each of the elongated first duct 32 and the elongated second duct 34. In any event, a joint 60 is provided between the elongated first duct 32 and the elongated second duct 34. In an embodiment, such joint 60 is configured between the first joint side 42 of the elongated first duct 32 and the second joint side 52 of the elongated second duct 34. The adjustable dryer vent adapter 30 is rotatably adjustable at joint 60, so that an angle alpha ($\alpha$) between the first longitudinal axis $L_1$ and the second longitudinal axis $L_2$ may be set to a desired value for angle alpha ($\alpha$).

Figure 7:
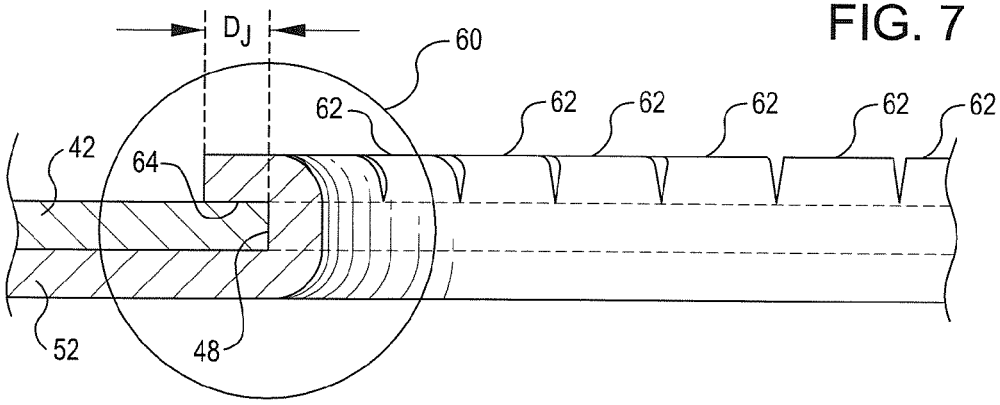
FIG. 7 provides a partial cross-sectional view to illustrate a first embodiment for construction of a joint between the first duct and a second duct, using a plurality of notched and crimped flange leaf elements.
Figure 8:
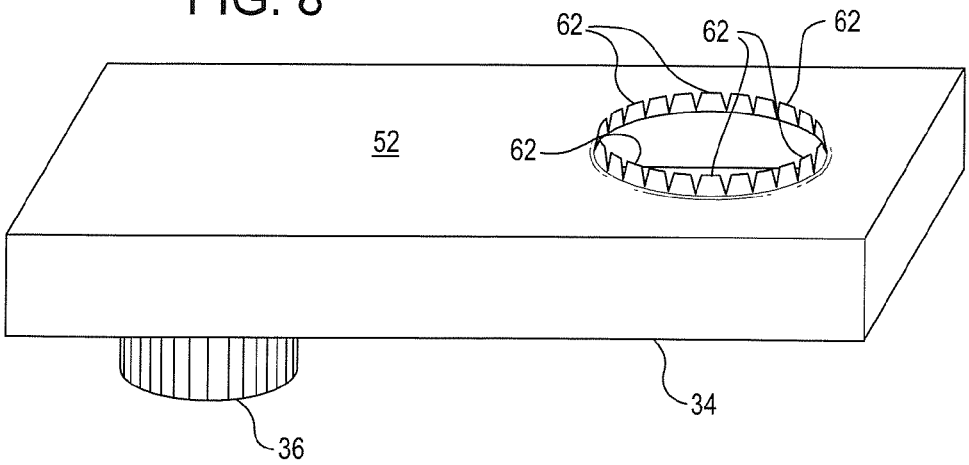
FIG. 8 provides a top perspective view of an embodiment of a second duct, before attachment to a first duct, showing a plurality of notched flange leaf elements that may be configured, after attachment, to provide a joint as set forth in FIG. 7 above.
Figure 9:
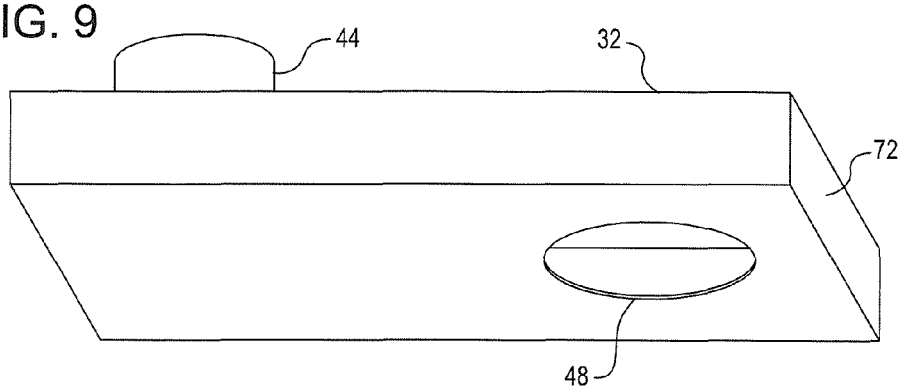
FIG. 9 provides a bottom perspective of an embodiment for an elongated first duct, before attachment of an elongated second duct, showing a circular sidewall that defines a through passageway in a back portion of the elongated first duct, and which circular sidewall is configured for attachment to the elongated second duct, for example by use of notched and crimped flange leaf elements as shown in FIGS. 7 and 8 above.

In an embodiment, as seen in FIG. 8, the second joint side 52 of the second duct 34 may include a plurality of flange tabs 62. As further illustrated in FIGS. 7 and 10, in an embodiment, the flange tabs 62 may be bent over the first joint side 42 of the elongated first duct 32, to mechanically connect the first joint side 42 with the second joint side 52 and thus form joint 60. However, embodiments may include use of flange tabs 62 on at least one of the first joint side 42 or the second joint side 52, adjacent the internal exit 46 or the internal inlet 54, respectively, in order to provided flange tabs 62 that mechanically connect the first joint side 42 and the second joint side 52 together. In various embodiments, the flange tabs 62 are turned and configured to extend a sufficient distance $D_J$ radially outward, as seen in FIGS. 7 and 10, and thence against the surface of the component being placed in compression (e.g., the inner surface 64 of the first joint side 42 as seen in FIGS. 7 and 10), to provide friction between the plurality of flange tabs 62 and the adjacent surface, e.g. the inner surface 64 of the first joint side 42 of the elongated first duct 32.

Figure 5:
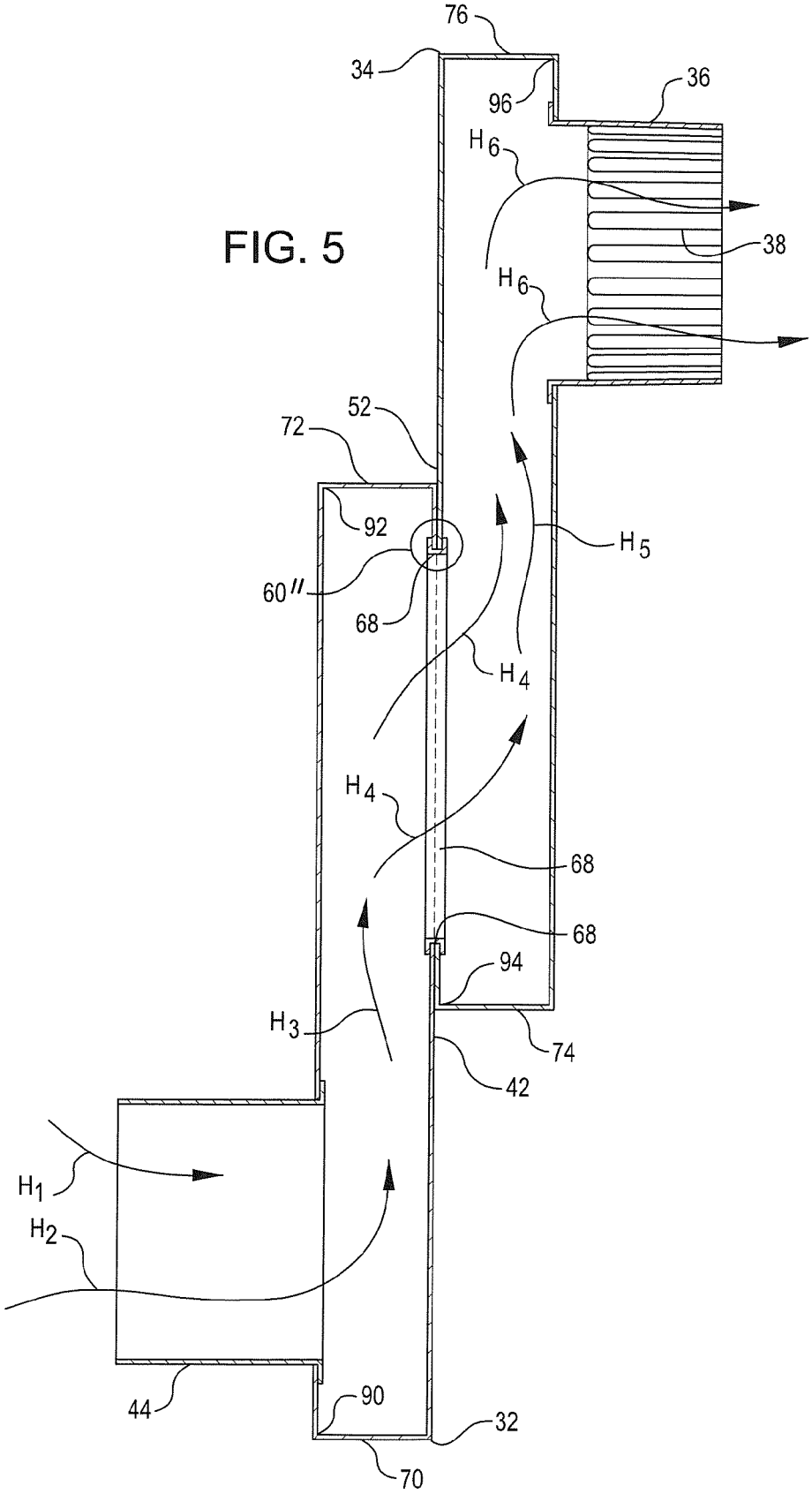
FIG. 5 provides a vertical cross-sectional view, showing an external inlet, an elongated first duct, a joint for passage of hot moist air from the elongated first duct to an elongated second duct, and an external outlet from the elongated second duct.
Figure 6:
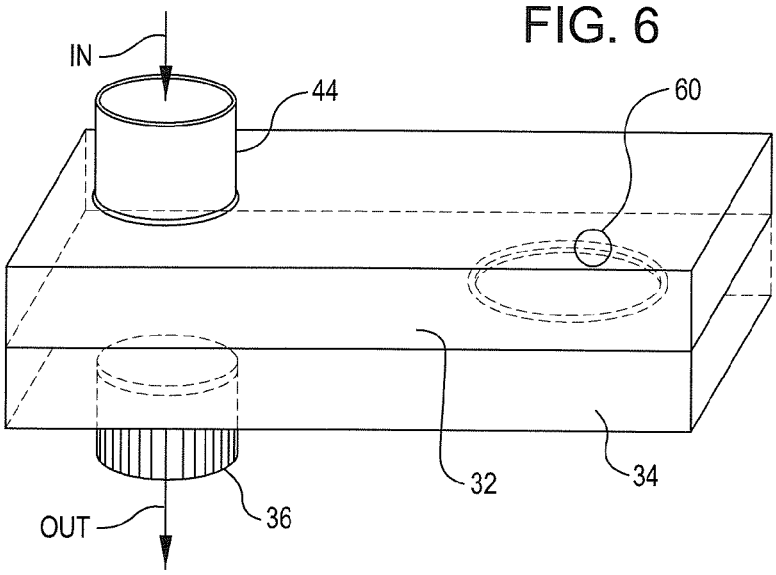
FIG. 6 shows an arrangement of the adjustable dryer vent, where there has been no angular displacement provided at the joint, and thus, the inlet and outlet are provided along a common baseline, and, in this embodiment, with their respective centerlines coincident.
Figure 10:
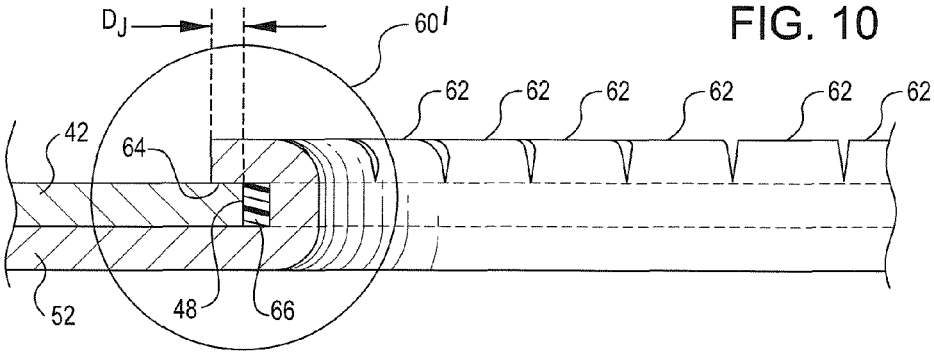
FIG. 10 provides another embodiment for construction of a joint between an elongated first duct and an elongated second duct, using a plurality of notched and crimped flange leaf elements, and further including a joint seal member that may both facilitate movement between the elongated first duct and the elongated second duct, and effectively seal the joint against escape of moisture laden air, during operation of a clothes dryer.

As illustrated in FIG. 10, in an embodiment, a joint 60' may be further provided with a seal 66. In various embodiments, seal 66 may be provided in an elastomeric material. In other aspects, joint 60' is similar to joint 60 as described otherwise herein. Alternately, in another embodiment as shown in FIG. 5, a dry lube rolled edge, clamped seal 68 may be provided with an internal lube layer seal, or, but with similar appearance to the embodiment illustrated in FIG. 5, an extruded polytetrafluoroethylene (Teflon®) retainer seal may be provided for clamped seal 68. In such embodiments, a clamped seal 68 may be seated either or both outlet sidewall 48 of internal exit 46, or the inlet sidewall 58 of internal inlet 54. In such an embodiment, the clamped seal 68 cooperates with the joint assembly to provide a sealed joint 60". In any event, in embodiments utilizing a seal, whether it be seal 66 as shown in FIG. 10, or seal 68 as shown in FIG. 5, or otherwise, the internal exit 46 has an outlet sidewall 48, and the seal 66 or 68 is provided in a sealing relationship adjacent the outlet sidewall 48.

As seen in the vertical cross-sectional view depicted in FIG. 5, during operation hot moist air as indicated by reference arrows $H_1$ and $H_2$ from a dryer (not shown) enters the external inlet 44 and thence traverses along the elongated first duct 32 as indicated by reference arrow $H_3$. Then, the hot moist air passes through joint 60" (or similarly, joint 60 or 60', in other embodiments) as indicated by reference arrows $H_4$. The hot moist air then traverses along the elongated second duct 34 as indicated by reference arrow $H_5$. Finally the hot moist air exits the external outlet 36 as indicated by reference arrows $H_6$.

As may be seen in the various figures, for example FIG. 2A, the external inlet 44 may be provided as a short, substantially cylindrical tubular portion.

In an embodiment, the external inlet 44 may be provided with a radius $R_{EI}$ such that the external inlet 44 has a nominal overall diameter of approximately four (4) inches.

As may be seen in the various figures, for example FIG. 2A, the external outlet 36 may be provided as a short, substantially cylindrical tubular portion. In an embodiment, the external outlet 36 may be provided with a radius $R_{EO}$ such that the external outlet 36 has a nominal overall diameter of approximately four (4) inches. In an embodiment, the external outlet 36 may be fluted, e.g. having a plurality of flutes 38.

In various embodiments, the primary components of the adjustable vent adapter 30 for clothes dryer may be conventional sheet metal. For example, in an embodiment, a suitable material may be 26 gauge galvanized sheet metal. Of course, thicker or thinner materials may be suitable. As illustrated in various drawing figures, in an embodiment, the elongated first duct 32 and the elongated second duct 34 may be provided in the general shape of hollow parallelepiped structures. As may be best seen in FIG. 5, in an embodiment, the elongated first duct 32 may have opposing first 70 and second 72 end panels. The elongated second duct 34 may have opposing third 74 and fourth 76 end panels.

Figure 11:
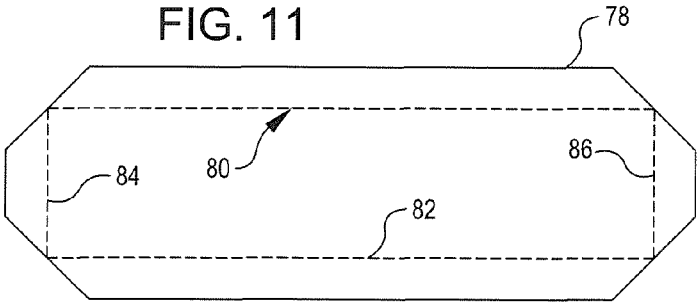
FIG. 11 provides the layout for assembly for fabrication of an end piece for an elongated first duct and/or an elongated second duct, showing how a piece of sheet metal may be bent along the indicated broken lines, such as by a sheet metal brake (not shown) to fit into a generally rectangular shaped end opening of a partially completed, rectangular cross-section shaped tubular structure for an elongated first duct or an elongated second duct.

The opposing first 70 and second 72 end panels, as well as the opposing third 74 and fourth 76 end panels, may be fabricated from sheet metal cut as a hexagonal shaped blank 78 as depicted in FIG. 11. Then, such aforementioned end panels may be bent along the broken lines 80, 82, 84, and 86 depicted in FIG. 11, normally at about a ninety (90) degree angle, for insertion into ends 90 and 92 of the elongated first duct 32, and ends 94 and 96 of the elongated second duct 34. The use of such first 70 and second 72 end panels, or of such opposing third 74 and fourth 76 end panels, enables such end panels to be fabricated from a friction fit sheet metal part. Alternately, or additionally, such end panels may be secured using conventional sheet metal assembly techniques.

Figure 12:
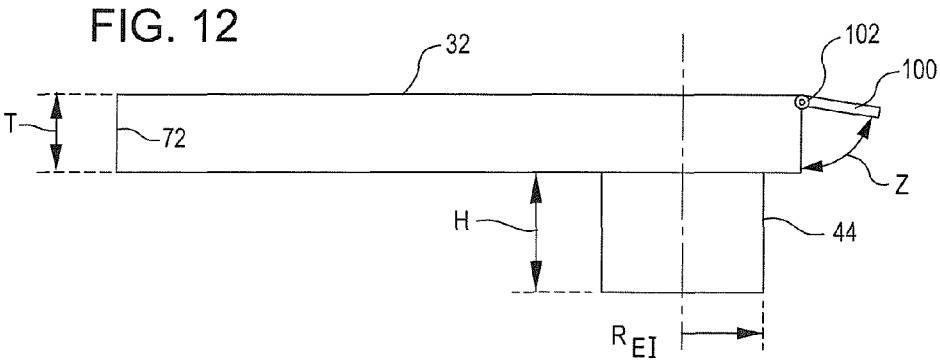
FIG. 12 is a side elevation view of an elongated first duct, showing how a hinged end panel may be used in the fabrication of an elongated duct, in order to provide a method and structure for cleaning of either an elongated first duct or an elongated second duct, rather than the simpler alternate method of construction using a fixed, insertable end piece, such as just illustrated in fabrication details noted in FIG. 11 above.

Alternately, as depicted in FIG. 12, either an elongated first duct 32 or an elongated second duct 34 may be provided with a first end panel and/or a second end panel which is configured as end panel 100, which is hingedly affixed, via hinge 102, to an elongated first duct 32 as depicted, or similarly, to an elongated second duct 34. The hinged end panel 100 is closed, or opened, as indicated by the arc of lead line noted with reference letter Z. Opening may provide the owner or operator of the dyer the ability to clean accumulated dust and lint from the adjustable dryer vent adapter 30, after a period of dryer operation. As also noted in FIG. 12, in an embodiment, an elongated first duct 32 may be provided having a thickness T of about one and three quarters (1.75) of an inch, more or less. An elongated second duct 34 may be provided with similar thickness T. In an embodiment, the external inlet 44 may be provided with an inlet length I of about three and one half (3.5) inches, more or less.

Figure 3:
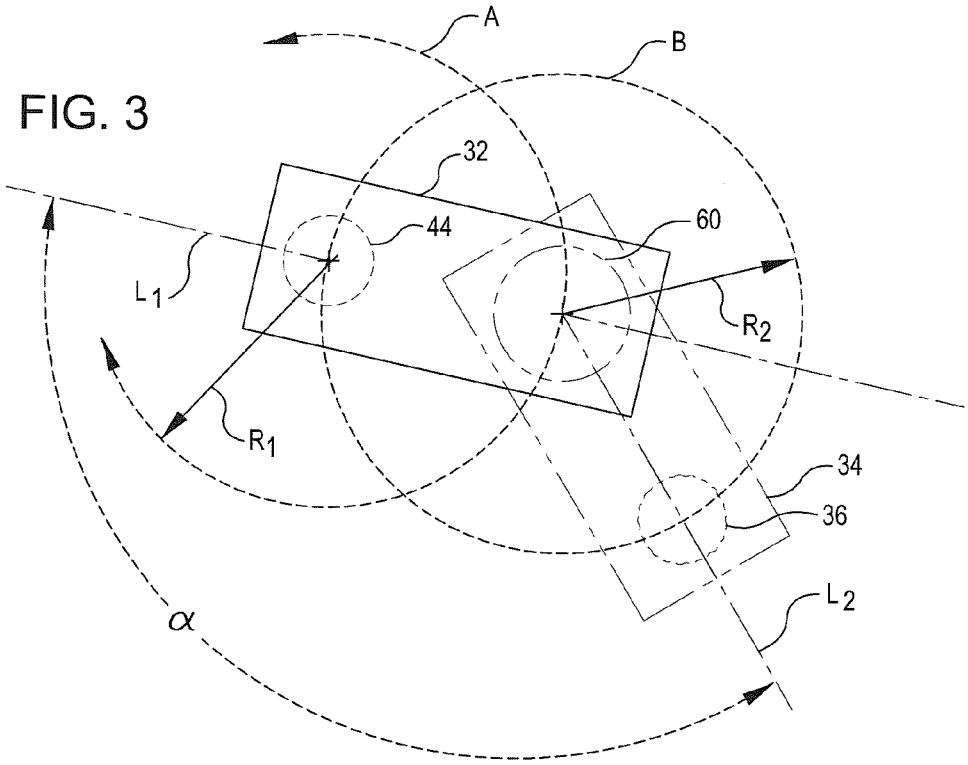
FIG. 3 provides a diagrammatic view of an embodiment of the adjustable vent adapter for clothes dryer which was depicted in FIGS. 1, 2, and 2A above, now showing that the adjustable vent adapter (a) may be adjusted to a desired position around an inlet centerline provided at the inlet to the first duct, with freedom of movement along a line A defined by radius $R_1$, which thus locates the centerline of the joint passageway between the first duct and the second duct, that is more precisely, between the inlet centerline and a joint centerline, and (b) may be rotated with freedom of movement along a line B defined by radius $R_2$, which extends between the joint centerline and the outlet centerline of the second duct.
Figure 4:
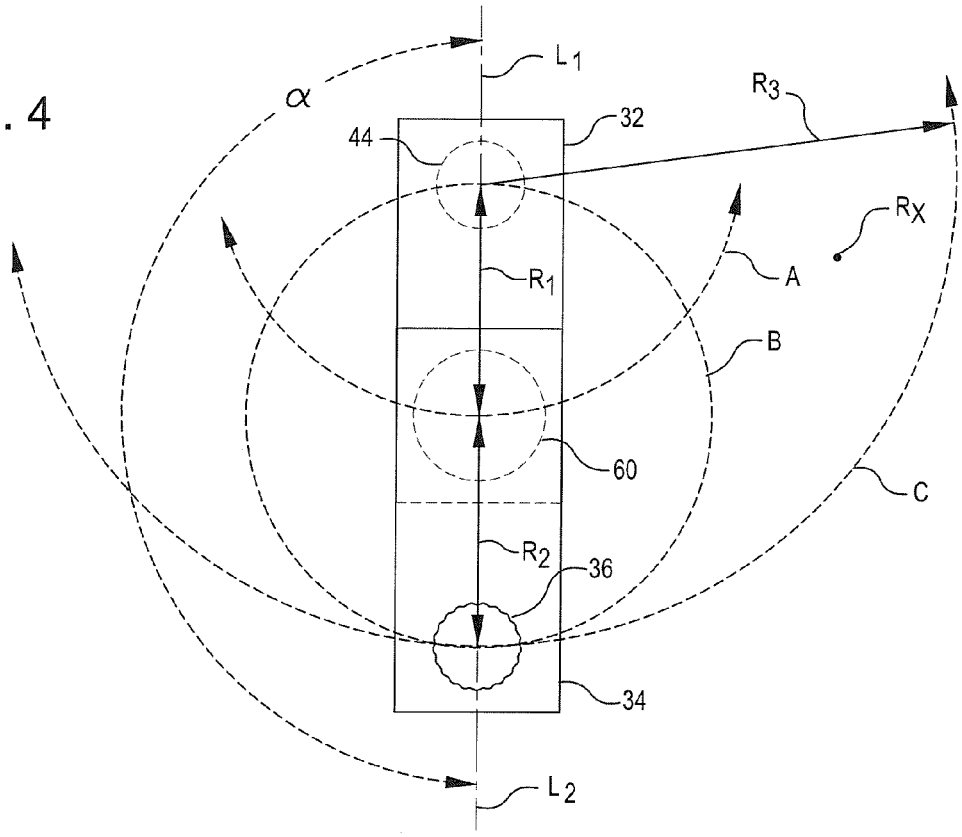
FIG. 4 provides a diagrammatic view of an embodiment of the adjustable vent adapter for clothes dryer which was depicted in FIGS. 1, 2, 2A, and 3 above, now showing that the adjustable vent adapter may be adjusted to a maximum extension position, wherein the second duct is rotated by an angle alpha ($\alpha$) of one hundred eighty (180) degrees with respect to the first duct, so that, in combination, the first duct and second duct provide an overall maximum extension distance of $R_3$, with freedom of movement along line C.

The flexibility afforded by use of the adjustable dryer vent adapter 30 as described herein may be more fully appreciated by review of the adjustment possibilities as illustrated in FIGS. 3 and 4. FIG. 3 provides a diagrammatic view, showing elongated first duct 32 having a first longitudinal axis $L_1$ and an elongated second duct 34 having a second longitudinal axis $L_2$. The elongated second duct 34 is rotated at joint 60 to provide an angle alpha ($\alpha$) between the first longitudinal axis $L_1$ and the second longitudinal axis $L_2$, which is FIG. 3 is an obtuse angle. In FIG. 4, the elongated second duct 34 is rotated at joint 60 to provide an angle alpha ($\alpha$) between the first longitudinal axis $L_1$ and the second longitudinal axis $L_2$ of one hundred eighty (180) degrees, which provides maximum length of extension (i.e. maximum length of $R_1$ plus $R_2$) for the adjustable dryer vent adapter 30. Note that the adjustable dryer vent adapter 30 may be adjusted to a desired position around an inlet centerline $C_L$ INLET provided at the external inlet 44, with freedom of movement along a line A defined by radius $R_1$, which thus locates the centerline $C_{L\ JOINT}$ of the joint 60 passageway between the elongated first duct 32 and the elongated second duct 34, i.e., between the inlet centerline $C_{L\ INLET}$ and a joint centerline $C_{L\ JOINT}$. The elongated second duct 34 may also be rotated with freedom of movement along a line B defined by radius $R_2$, which extends between the joint centerline $C_{L\ JOINT}$ and the outlet centerline $C_{L\ OUTLET}$ of the elongated second duct 34.

Note that FIG. 4 provides a diagrammatic view of an embodiment of the adjustable dryer vent adapter 30 where the vent adapter 30 has been adjusted to a maximum extension position, that is, wherein the elongated second duct 34 has been rotated by an angle alpha ($\alpha$) of one hundred eighty (180) degrees with respect to the elongated first duct 32, so that, in combination, the elongated first duct 32 and the elongated second duct 34 provide an overall maximum extension distance of $R_3$, with freedom of movement along a line C. Moreover, note that for any given extension distance $R_3$ (i.e. the sum of $R_1$ and $R_2$) an adjustment distance, and location, may be accommodated from the external inlet centerline $C_{L\ INLET}$ to any point located within the area defined by the bounding line C, i.e. any point with a desired extension radius $R_X$ equal to or less than $R_3$.

It is to be appreciated that the various aspects, features, structures, and embodiments of an adjustable vent adapter for clothes dryer as described herein is a significant improvement in the state of the art. The apparatus described is simple, reliable, and easy to use. Although only a few exemplary aspects and embodiments have been described in detail, various details are sufficiently set forth in the drawing figures and in the specification provided herein to enable one of ordinary skill in the art to make and use the invention(s), which need not be further described by additional writing.

Importantly, the aspects, features, structures, and embodiments described and claimed herein may be modified from those shown without materially departing from the novel teachings and advantages provided, and may be embodied in other specific forms without departing from the spirit or essential characteristics thereof. Therefore, the various aspects and embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. The scope of the invention, as described herein is thus intended to include variations from the various aspects and embodiments provided which are nevertheless described by the broad meaning and range properly afforded to the language herein, as explained by and in light of the terms included herein, or the legal equivalents thereof.

The invention claimed is:

1. An adjustable dryer vent adapter, comprising:

an elongated first duct, said elongated first duct comprising an inlet side and a first joint side, said inlet side further comprising an external inlet, and said first joint side further comprising an internal exit, said external inlet and said internal exit spaced apart along a first longitudinal axis in a non-overlapping configuration;

an elongated second duct, said elongated second duct comprising an outlet side and a second joint side, said outlet side further comprising an external outlet, and said second joint side further comprising an internal inlet, said internal inlet and said external outlet spaced apart along a second longitudinal axis in a non-overlapping configuration; and a joint mechanically connecting said first joint side of said elongated first duct and said second joint side of said elongated second duct, said joint rotatably adjustable, so that an angle alpha ($\alpha$) between said first longitudinal axis and said second longitudinal axis may be set to a desired value for angle alpha ($\alpha$);

wherein at least one of said first joint side of said elongated first duct or said second joint side of said elongated second duct comprises a plurality of flange tabs adjacent said internal exit or said internal inlet, respectively, and wherein said plurality of flange tabs mechanically connect said first joint side and said second joint side together.

2. The apparatus as set forth in claim 1, wherein said flange tabs extend from said second joint side of said elongated second duct, and are configured to provide friction between said plurality of flange tabs and said first joint side of said elongated first duct.

3. The apparatus as set forth in claim 1, wherein said external outlet is fluted.

4. The apparatus as set forth in claim 1, wherein said elongated first duct and said elongated second duct are each provided shaped as hollow parallelepiped structures having opposing first and second end panels.

5. The apparatus as set forth in claim 4, wherein at least one end of said first and second end panels is hingedly affixed.

6. The apparatus as set forth in claim 4, wherein at least one of said first and second ends comprises a friction fit fabricated sheet metal end part.

7. The apparatus as set forth in claim 1, wherein plurality of flange tabs are integrally formed from said second joint side of said elongated second duct, said plurality of flange tabs bent to penetrate into said elongated first duct and to frictionally engage an inner surface of said first joint side of said elongated first duct.

8. The apparatus as set forth in claim 7, further comprising a seal seated on said internal exit, said seal cooperating with said joint assembly to provide a sealed joint.

9. The apparatus as set forth in claim 7, further comprising a seal seated on both said internal exit and on said internal inlet, said seal cooperating with said joint assembly to provide a sealed joint.

10. The apparatus as set forth in claim 8 or in claim 9, wherein said seal comprises an extruded polytetrafluoroethylene flexible retainer.

* * * * *